US008166969B2

(12) United States Patent
Hall et al.

(10) Patent No.: US 8,166,969 B2
(45) Date of Patent: May 1, 2012

(54) CHEMICALLY AND BIOLOGICALLY RESISTANT HYDRATION SYSTEM

(75) Inventors: Peyton W. Hall, Austin, TX (US); Frank T. Zeller, Austin, TX (US); John Werner Bulluck, Spicewood, TX (US); Michael L. Dingus, Austin, TX (US)

(73) Assignee: Texas Research International, Inc., Austin, TX (US)

( * ) Notice: Subject to any disclaimer, the term of this patent is extended or adjusted under 35 U.S.C. 154(b) by 1712 days.

(21) Appl. No.: 10/092,030

(22) Filed: Mar. 6, 2002

(65) Prior Publication Data

US 2002/0179647 A1 Dec. 5, 2002

Related U.S. Application Data

(60) Provisional application No. 60/273,694, filed on Mar. 6, 2001.

(51) Int. Cl.

| | |
|---|---|
| ***A61M 15/00*** | (2006.01) |
| ***A61M 5/00*** | (2006.01) |
| ***B65D 33/10*** | (2006.01) |
| ***B65D 33/01*** | (2006.01) |
| ***B65D 30/08*** | (2006.01) |
| ***B65D 33/02*** | (2006.01) |
| ***B65D 35/00*** | (2006.01) |
| ***B65D 3/00*** | (2006.01) |
| ***B65B 53/00*** | (2006.01) |
| ***B32B 27/00*** | (2006.01) |
| ***B32B 27/08*** | (2006.01) |

(52) U.S. Cl. ..... 128/202.15; 604/262; 383/9; 383/101; 383/113; 383/119; 428/35; 428/475.8; 428/476.1; 428/516; 428/518; 222/92; 222/107; 222/527; 222/529; 222/482

(58) Field of Classification Search ..... 128/202.15; 222/92, 107, 527, 529, 482; 604/262; 383/9, 383/101, 113, 119; 428/35, 475.8, 476.1, 428/516, 518

See application file for complete search history.

(56) References Cited

U.S. PATENT DOCUMENTS

| | | | | | |
|---|---|---|---|---|---|
| 3,187,965 | A | * | 6/1965 | Bourget | 222/518 |
| 3,229,014 | A | * | 1/1966 | Petriello | 264/250 |
| 3,642,047 | A | * | 2/1972 | Waage | 383/109 |
| 4,362,255 | A | * | 12/1982 | Bond | 222/107 |
| 4,482,585 | A | * | 11/1984 | Ohodaira et al. | 428/35.2 |
| 4,636,412 | A | * | 1/1987 | Field | 604/408 |
| 4,753,368 | A | * | 6/1988 | Lescaut | 220/62.22 |

(Continued)

OTHER PUBLICATIONS

International Search Report, Aug. 21, 2002.

*Primary Examiner* — Kim M Lewis
*Assistant Examiner* — Nihir Patel
(74) *Attorney, Agent, or Firm* — O'Keefe, Egan, Peterman & Enders, LLP

(57) ABSTRACT

A hydration system for providing fluid to a user. The system comprises a bladder configured to hold a fluid, wherein comprises an outer layer of a fluorinated rubber composite. A spout is connected to the bladder and in communication with the inside of the bladder, wherein the spout comprises an output port and an fill port for filling the bladder with fluid. A cap adapted to engage and close the fill port is included. Also, a tube having a first end is connected to the output port of the spout and having a second end and having a second end connected to a fluid delivery fitting.

24 Claims, 4 Drawing Sheets

U.S. PATENT DOCUMENTS 4,928,681 A 5/1990 Langston et al.
5,112,660 A 5/1992 Saito et al.
5,365,260 A 11/1994 Kitani et al. ..... 347/87
5,468,526 A * 11/1995 Allen et al. ..... 428/35.4
5,472,124 A 12/1995 Martushev
5,988,435 A 11/1999 Edwards et al.
6,032,831 A * 3/2000 Gardner et al. ..... 222/175
6,156,400 A 12/2000 Jing et al.
6,247,619 B1 * 6/2001 Gill et al. ..... 222/105
6,253,936 B1 * 7/2001 Kong ..... 215/11.3
2002/0014498 A1 * 2/2002 Forsman et al. ..... 222/92
2003/0039781 A1 * 2/2003 D'Alessio et al. ..... 428/35.7

* cited by examiner 110
100
120
130
a
150
144
140
144

CHEMICALLY AND BIOLOGICALLY RESISTANT HYDRATION SYSTEM

This application claims priority to provisional application Ser. No. 60/273,694, filed Mar. 6, 2001, incorporated herein by reference.

Subject to right of the assignee afforded under a Small Business Innovation Research (SBIR) program, the U.S. government has a paid-up license in this invention and the right in limited circumstances to require the patent owner to license others on reasonable terms as provided for by the terms of contract number N68335-99-C-0119 which was supported by the Naval War Center.

BACKGROUND OF THE INVENTION

The threat of chemical and biological warfare has accelerated the implementation of protective clothing for aircrew personnel. This protective clothing insulates aircrew personnel and accentuates the need for hydration during long or hot weather missions. Decline in mental performance with lack of proper hydration has been well documented and it is likely that physical performance is also affected. Pilots must have the tools to hydrate in flight to maintain peak performance even in a chemical biological warfare (CBW) environment. Therefore, the present inventors have recognized that it would be desirable to have a personal hydration system designed for cockpit use to meet the hydration need, as well as provide CBW hardened protection of that water source from HD and GB agents.

SUMMARY OF THE INVENTION

This invention provides a solution to one or more of the problems or needs or both identified above.

In one respect, a hydration system for providing fluid to a user, comprising: a bladder configured to hold a fluid, wherein bladder comprises an outer layer of a chemically resistant composite such as a fluorinated rubber composite; a spout connected to the bladder and in communication with the inside of the bladder, wherein the spout comprises an output port and an fill port for filling the bladder with fluid; a cap adapted to engage and close the fill port; a tube having a first end connected to the output port of the spout and having a second end connected to a fluid delivery fitting. In this system, the bladder may be flexible; the bladder may comprise an inner layer of thermoplastic polyurethane; the second end of the tube may connect to a closable, rigid drink straw; the drink straw may be made of metal; the cap may be adapted to screw into the fill port; the spout may have a width and a height, wherein the width may be greater than height; including a width at least two times greater than the height; and combinations thereof;

In another broad respect, this invention is a process for manufacturing a hydration system, comprising: connecting a spout to a laminate used to form a bladder by securing the spout in a hole in the laminate; forming a bladder from the laminate, wherein the laminate comprises an outer fluorinated rubber composite layer and an inner layer of a thermoplastic polymer; connecting a first end of a tube to an output port of the spout; and connecting a fluid delivery fitting to a second end of the tube. This process may further comprise engaging a cap to an fill port of the spout, attaching a tube to an output port of the spout; and/or attaching a first end of a tube to an output port of the spout, wherein the tube includes a second end to which is affixed a closable mouthpiece to deliver fluid to a user or to which may be affixed a closable connector for connecting to another piece of equipment, such as a drink straw, from which a user would intake the fluid.

In another broad respect, this invention is a method of storing a fluid, comprising: at least partially filling the hydration system an fill port with a fluid, and closing the system by engaging the cap to the fill port, wherein the hydration system comprises: a bladder configured to hold a fluid, wherein bladder comprises an outer layer of fluorinated rubber composite; a spout connected to the bladder and in communication with the inside of the bladder, wherein the spout comprises an output port and an fill port for filling the bladder with fluid; a cap adapted to engage and close the fill port; a tube having a first end connected to the output port of the spout and having a second end connected to a fluid delivery fitting.

In another broad respect, this invention is a bladder to store fluid, comprising: an inner bladder layer of a thermoplastic polymer and an outer bladder encompassing the inner bladder, wherein the outer bladder layer comprises fluorinated rubber. The inner bladder layer can be comprised of thermoplastic polyurethane. The outer bladder can be comprised of a multiplayer laminate of the fluorinated rubber layer, a polyamide reinforcement layer, and a thermplastic polymer layer. The bladder can include a hole to fill the bladder with liquid. The hole can mounted with a spout and cap.

The fluid used with the hydration system of this invention may be water, or any other fluid. The particular selection of fluid is not critical in the practice of this invention.

DETAILED DESCRIPTION OF THE INVENTION

Figure 1:
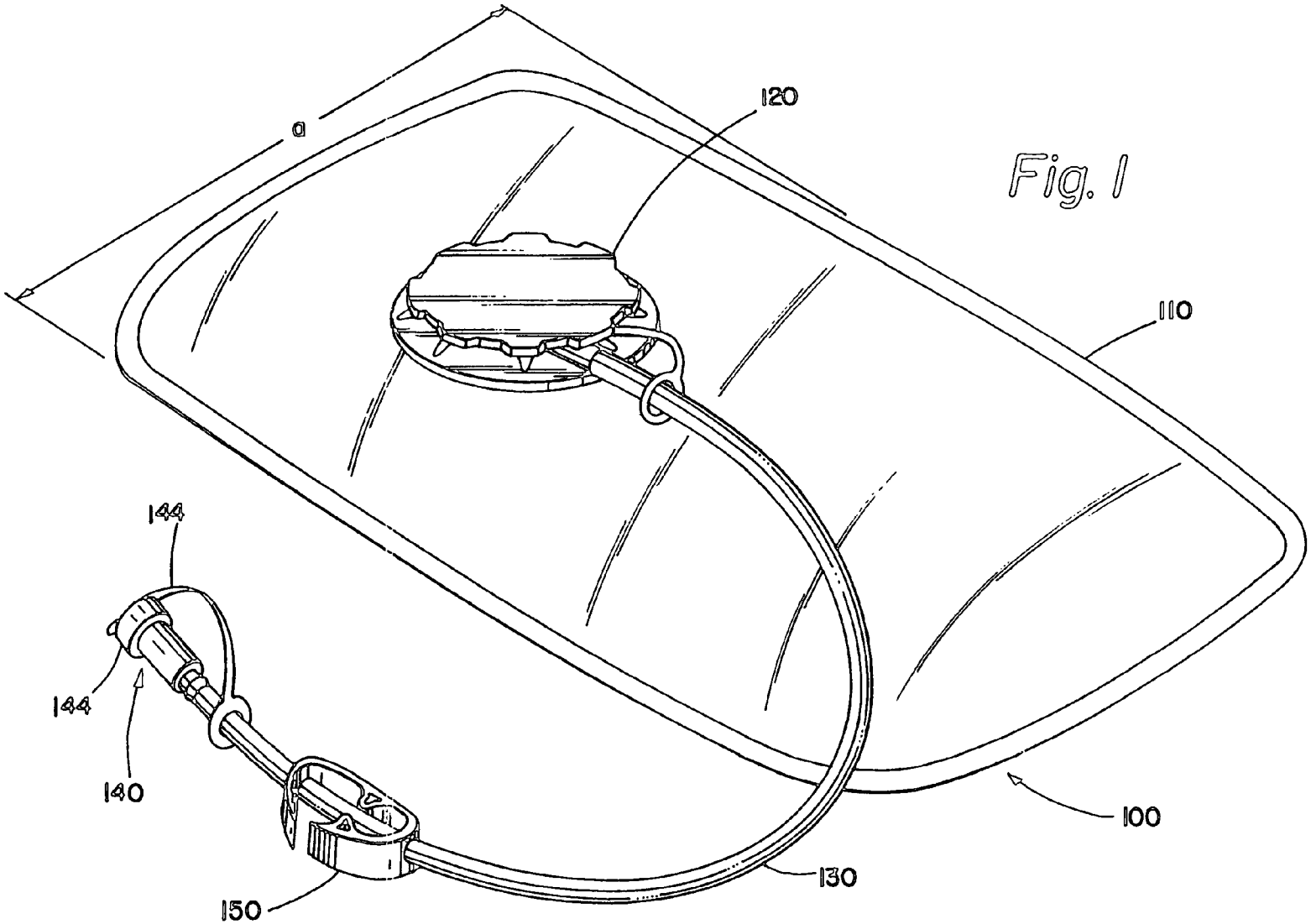
FIG. 1 is a top view of one representative embodiment of the hydration system.

A new hydration system subject of this invention was developed to exceed the capabilities of the previous generation two-quart canteen. The previous generation two-quart canteen used by the US military was designed neither for chemical and biological warfare use nor aviator use. This ethylene-vinyl acetate (EVA) canteen only provided a "disposable" CBW solution for ground forces. The new hydration system, comprising a water bladder (or "pouch"), fill port, drink tube, and connecting hardware can be designed for aviator use with the CBW protective ensemble. The hydration system may be designed to integrate with existing CBW aviator hardware and is unobtrusive in a tightly packed cockpit. Construction can be modular and would allow adaptation to other military and non-military personal hydration configurations.

In one embodiment, this invention provides a durable, flexible hydration system resistant to contamination by contact with GB and HD chemical agents, for aviator use, for example, and may be of many different designs for a wide range of end users. In deciding on a design, there are often conflicting concerns of water potability and protection from chemical agents in compliant polymeric materials. Water potability and health concerns dictate the use of high purity thermoplastic resins with very limited use of lubricants, accelerators, antioxidants, and plasticizers. Flexible chemically resistant applications demand the use of highly crosslinked, permeation resistant, plasticized elastomers or thermosets. By using multilayer laminated and unlaminated polymer composites, as well as closely examining permeation properties, a balance has been reached to meet these conflicting requirements.

In one non-limiting respect, this invention is a water pouch for use by aviators. The CBW flexible hydration system was designed to integrate with existing aircrew hardware. First, it had to fit inside the AIRSAVE vest. This requirement necessitates flexibility because the water pouch is worn directly against the body, with several components mounted on the outside of the vest. One way to ensure comfort for the pilot was to make the pouch completely compliant. Second, the pouch was required to connect directly to the M45 protective mask. The M45 mask connects to the M1 cap using, for example, an ethylene propylene diene monomer (EPDM) rubber tube and a metal drinking straw. The M1 cap, however, is a large, stiff component that will not fit comfortably inside a vest. Instead, a low profile fill port with a remote connection to the metal straw used with the M1 cap was designed. Without the connection for the metal straw provided by the M1 cap, a new location for the drink straw receptacle was required. This fitting was located on the end of a flexible tube that connects to the low-profile spout. The fitting was designed such that it can either be used with the drinkstraw, or in a non-CBW or emergency situation, can be drunken from directly. This situation might occur after a pilot has ejected and is awaiting rescue, but no longer wearing the M45 mask. As used herein, this fitting may be referred to as a fluid delivery fitting.

Turning to FIG. 1, a perspective view is shown of one representative hydration system 100 of this invention. The hydration system includes a bladder 110, a spout 120, a tube 130, a fluid delivery fitting 140 that is configured to provide fluid to a user and which can be closed when not in use, and an optional pinch valve 150 that serves to stop the flow of fluid through the tube. Claims may be used to seal the connections between the ends of the tube and the fluid delivery fitting and the output port. The fluid delivery fitting may be in the form of a mouthpiece, such as are well known in the art, for direct use by a user. The particular style and construction of the fluid delivery device is not critical in the practice of this invention. The fluid delivery fitting may also be configured to engage a separate delivery device, such as a metal drink straw that is used currently by aviators and in this regard may be considered a drink tube adapter (or drink straw adapter). As used herein, "fluid delivery fitting" refers to either of these alternatives unless otherwise specified. A stopper 144, which is connected to lanyard 144*a*, may be used to close the fluid delivery fitting when not in use, to thereby prevent fluid from exiting. Similarly, the cap may be attached to a lanyard, which may connect for example to the tube. The bladder is comprised of an outer fluorinated rubber composite layer and an inner thermoplastic polyurethane layer. The bladder, which may be composed of an inner thermoplastic polyurethane bladder layer and an outer fluorinated rubber composite bladder layer, defines an internal reservoir that holds fluid (the bladder is hollow), the fluid being in direct contact with the polyurethane layer. The outer bladder layer is formed from a chemically resistant polymer composite that serves to protect the inner bladder layer from aggressive chemicals and biological agents. The spout preferably has a low profile. The spout may be threaded with a corresponding threaded cap 122 to engage and cover the fill port. The tube connects to an output port of the spout. The hydration system may include additional spouts, tubes and fluid delivery fittings as desired. The hydration system 100 may be a variety of designs/configurations depending on the needs of the end use. In the configuration of FIG. 1, the hydration system has a length which is greater than its width which is greater than its height. The hydration system may also include an internal assembly, in communication with the output port, so that fluid may be drawn from the very bottom of the hydration system during use, such as toward end "a".

Figure 2:
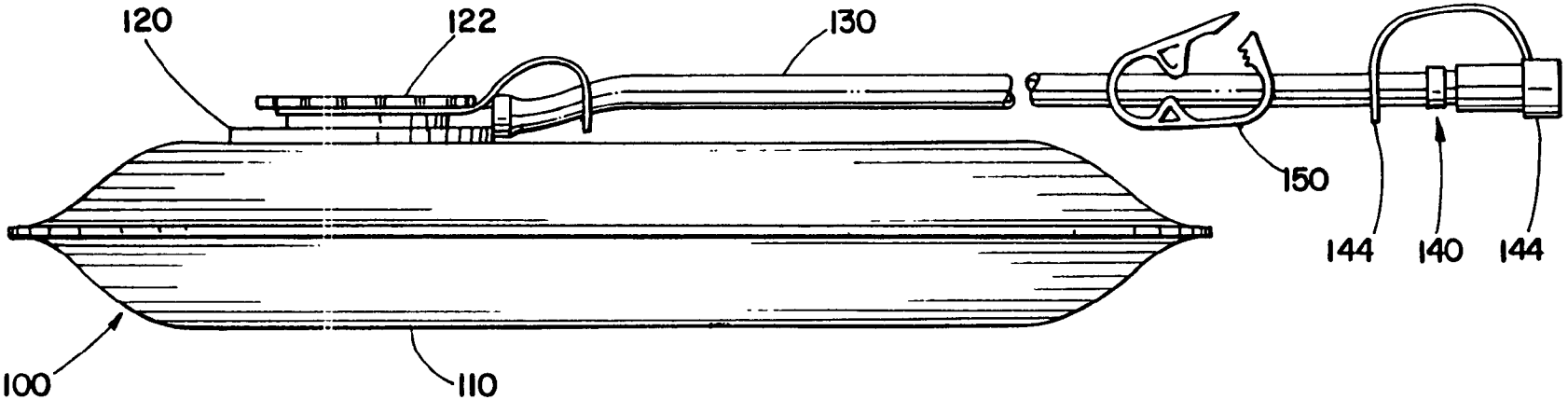
FIG. 2 is a side view of one representative embodiment of the hydration system.
Figure 3:
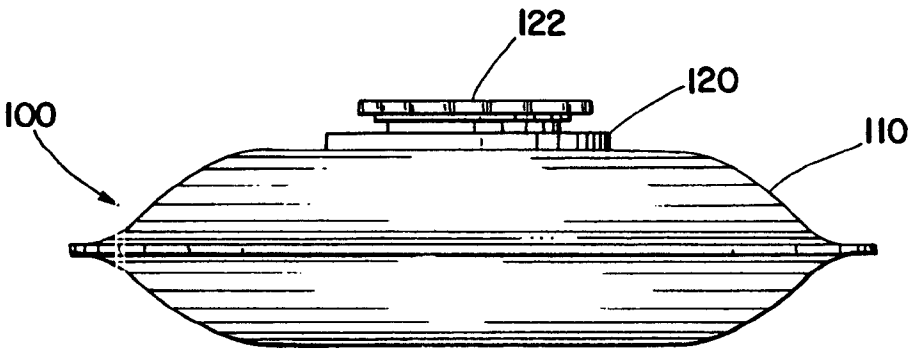
FIG. 3 is another side view of one representative embodiment of the hydration system.

FIG. 2 is a side view of the hydration system 100. In FIG. 2, the cap 122 is more fully shown. FIG. 3 is another side view of the hydration system from the "a" end.

Figure 4:
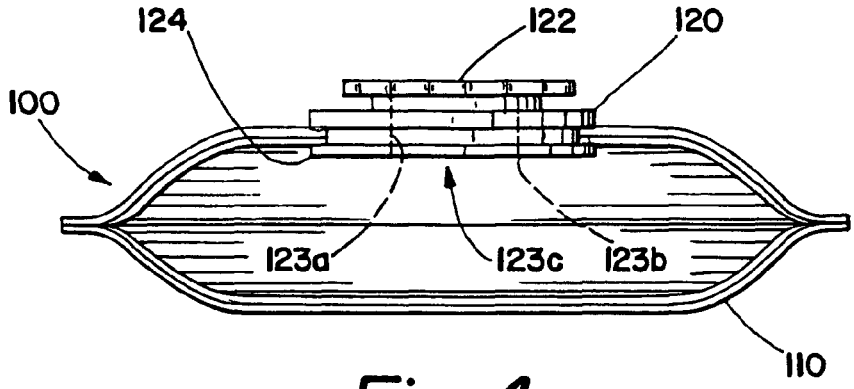
FIG. 4 is a cutaway view of one representative embodiment of the hydration system.

FIG. 4 shows a cutaway view of the hydration system 122. The fill port 123*c* is a bore defined by phantom lines 123*a* and 123*b*. The spout is configured to be inserted through a hole in the bladder 110, and fastened into place by, for example, screws threaded into the inner section 124, which forms a part of the spout. This may be accomplished by installing the spout prior to thermally welding to form the bladder and optional taping of the welded edges to increase strength of the seal. One or more O-rings and/or raised edges may be used to ensure a tight seal at the interface of the spout and the bladder material. The O-rings (seals) can be made of Viton™ fluorinated rubber. The inner section 124 may be adapted so as to be a separate piece that can be affixed to the spout 120 so as to hold the spout in the hole of the bladder and provide a seal so that the hydration system does not leak. The inner section 124 can also be contiguous with the spout 120, and may engage the hole in the bladder by a gap between the end and the other end of the spout, fastened into place by use of screws, rivets or the like so as to crimp the bladder and thereby seal the hole and hold the spout in place. FIG. 4 also shows a cutaway of the bladder, with two layers shown.

Figure 5:
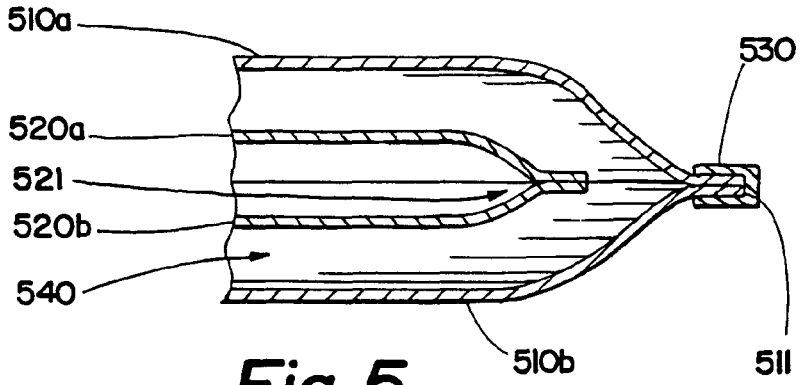
FIG. 5 is a cutaway view of a bladder at a sealed edge.

FIG. 5 shows a cutaway view of the bladder material at a sealed edge of one embodiment of the invention. In FIG. 5, thermoplastic polyurethane layers 520*a*, 520*b* are heat sealed to form an edge 521. Two fluorinated rubber composite layers 510*a*, 510*b*, which can include a polyamide reinforcement layer sandwiched between a fluorinated rubber layer and a heat sealable thermoplastic polymer layer, are thermally welded to form edge 511. The edge 511 may be further reinforced by use of tape 530. It can be seen that in one embodiment, the present invention provides a bladder that is composed of an inner polyurethane bladder formed from the polyurethane layers 520*a* and 520*b*, and an outer protective bladder formed from fluorinated rubber composite. There may be a gap 540 between the layers when the layers are lying loosely together. Stated differently, this embodiment provides a pouch within a pouch, with the inner bladder forming a reservoir in contact with the fluid. Thus, though the layers can be bonded together, the thermoplastic polyurethane layer and the fluorinated rubber layer need not be bonded to one another. Though not necessarily bonded together, the inner and outer bladder layers may of course be in full, contiguous contact when the hydration system is filled with a fluid.

Figure 6:
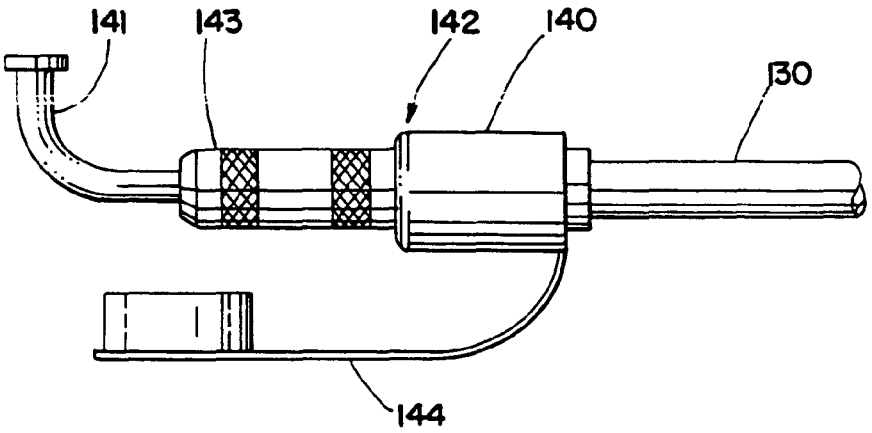
FIG. 6 is a representative drinking straw for use with the hydration system.

FIG. 6 shows a representative configuration of a hydration system that has the fluid delivery fitting 140 connected to a drink straw 143 (or "drink tube"). Thus, in this configuration the fluid delivery fitting is configured to receive the drink straw. It should be appreciated that the drink straw may include a wide variety of additional styles. In FIG. 6, the drink straw 143 includes an end 141 that a user may draw from directly or which may be connected to a separate hydration assembly. The hydration system of this configuration may be closed by engaging stopper 144 to the tip of end 141. The stopper 144 may be configured to also engage and close the fluid delivery fitting when the drink straw is absent. The stopper 144 is connected to the body 142 by a lanyard 144*a* in FIG. 6 for ease of use, but may be separate or connected to another part of the hydration system.

Figure 7:
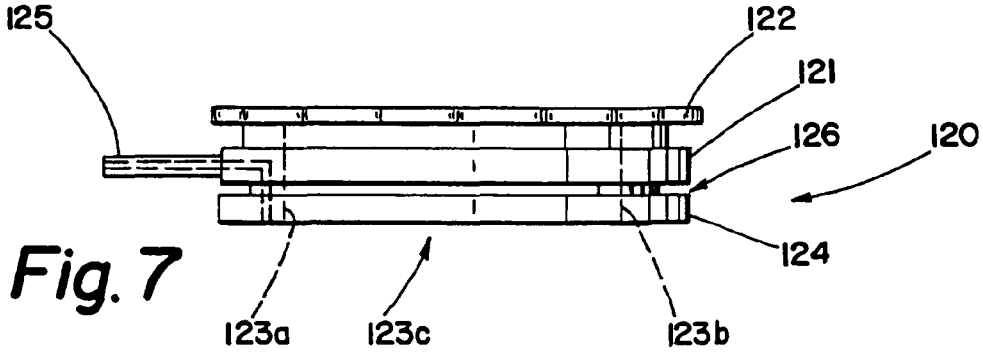
FIGS. 7, 8, and 9 are side, perspective, and exploded views of the spout and cap.
Figure 8:
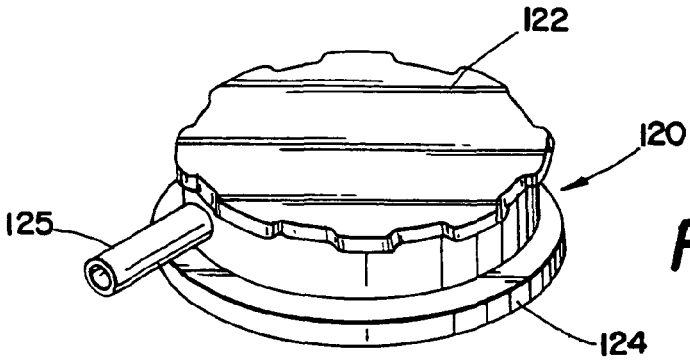
Figure 9:
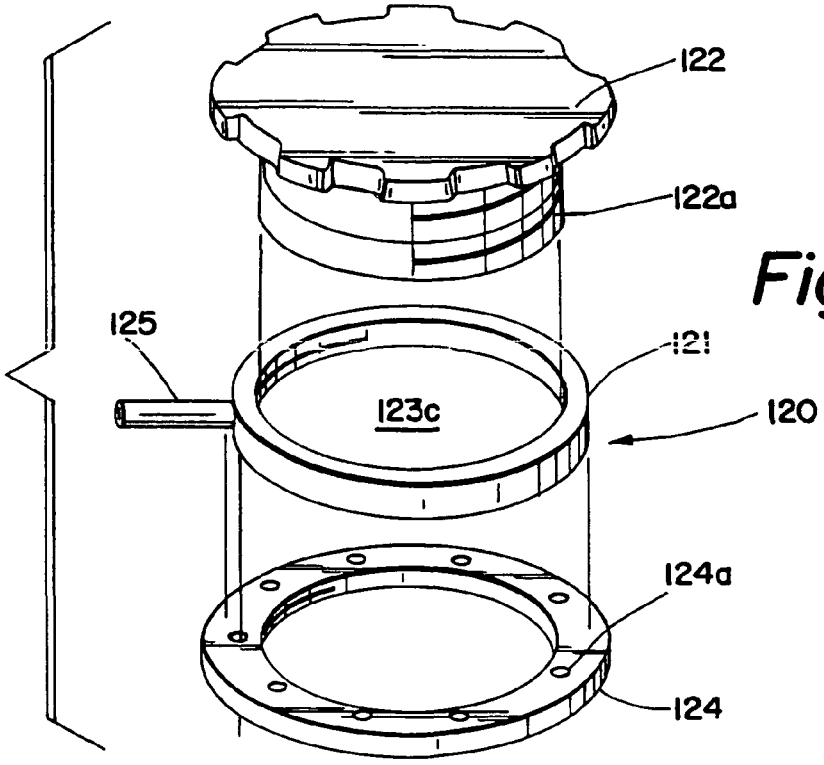

FIG. 7 shows a side view of the spout and cap. The cap 122 is engaged into the fill port 123*c* defined by phantom lines 123*a* and 123*b*. The spout includes an output port 125 which may be connected to the tube 130. In FIG. 7, there is shown a gap 126 between the inner section 124 (which during use would be on the inside of the bladder) and outer section 121 that make up a portion of the spout. After installation, the a portion of the bladder material will be seated between the inner section 124 and outer section 121, with O-ring (which may be made of Viton™ fluorinated rubber) and/or raised edges employed to ensure that a seal is formed. It should be appreciated that the cap 122 and fill port 123*c* may be threaded so that the cap may be screwed into place to close and seal the fill port. It should also be appreciated that the spout and cap of FIGS. 7-9 are representative, and a range of styles and sizes of spouts and caps may be employed. Likewise, a variety of materials may be used to make the spout and cap. In one alternative, the spout and cap are made by injection molding using an appropriate polymer or polymer blend, such as polyamide (Nylon 612) with 30% glass fibers for reinforcement. The lanyards, fluid delivery fitting, and stopper can be made of a relatively flexible material such as polyphenylene oxide ("PPO").

FIG. 8 shows a perspective view of the spout 120 and cap 122. From this angle it should be appreciated that the output port 125 includes a bore through which fluid flows.

FIG. 9 is an exploded view of the spout 120 and cap 122, which shows in this case the cap including a threaded portion 122*a* that engages the fill port of the spout 120. In FIG. 9, the inner section 124 is separate from outer section 121 prior to assembly. The inner section 124 includes holes 124*a* through which screws may be threaded into the outer section 121 so as to engage and grip the bladder material. With reference to FIG. 7, the bladder material would become engaged in gap 126.

The bladder typically holds from one pint to two gallons of fluid, though greater volumes can be held. The bladder is made up of at least two layers, including a fluorinated rubber layer and a thermoplastic polyurethane layer. The fluorinated rubber composite layer itself can contain multiple layers and/or components, and may include in this regard polyamide reinforcement.

While a variety of polymeric materials can be employed, aromatic thermoplastic polyurethane is the preferred inner bladder material to come in contact with the fluid for several reasons. First, it is flexible and tough over a wide temperature range without the use of plasticizers. Ultimate elongations of 500 to 600 percent are typical for urethanes without plasticizers. Other polymers such as PVC require additives to retain flexibility at room temperature, and still become brittle at near freezing temperatures. With regards to mechanical properties, the only other competing materials are elastomers, or rubbers. However, rubbers must be crosslinked by vulcanization using sulfur to obtain useful mechanical properties. Unreacted sulfur or accelerators, even in very small amounts, imparts a foul taste to water that contacts it for any significant period of time. Additionally, typical rubbers must be chemically glued together, whereas polyurethane is a thermoplastic that readily forms strong thermal welds. Chemical bonding introduces another set of potentially toxic chemicals to drinking water and can be less reliable mechanically. The only problem with thermoplastic urethane is that it has relatively low resistance to permeation by chemical agents. An outer barrier was therefore employed.

For the outer protective covering, a chemically resistant composite is employed. One representative example of such a chemically resistant composite layer is fluorinated polymer such as fluorinated rubber. A multilayer laminate already proven worldwide in industrial chemical protective applications can be utilized. This laminate meets performance requirements, including permeation, flammability, and abrasion resistance, of the National Fire Protection Association (NFPA) 1991,1994 edition standard. This laminate may be composed of several polymeric layers including a polyamide fiber reinforcement layer for strength, several rubber layers for permeation resistance, and a thermoplastic layer to allow for thermal welding. More particularly, the multiplayer laminate/composite includes a layer of fluorinated polymer such as fluorinated rubber. This layer may include other rubber materials. A representative example of such a fluorinated rubber is Viton™ rubber available from DuPont. These fluorinated rubbers may be based on hexafluoropropylene and vinylidene fluoride. Such materials are well known as being chemically resistant. Thus, in general, the fluorinated rubber composite may be multiplayer and include a polyamide reinforcement layer sandwiched between a thermoplastic polymer layer (to all for thermal welding) and the fluorinated rubber. As used herein, "fluorinated rubber composite" or "fluorinated rubber laminate" refers to materials that include one or more fluorinated rubber layers, but may include other layers such as the polyamide and thermoplastic polymer layers. It is possible that other chemically resistant polymers be used instead of fluorinated rubber.

The tubing employed may be of a variety of lengths and diameters, depending on the end use. The tubing is typically made of a flexible plastic tubing, such as silicon tubing and vinyl polymer tubing (e.g., Tygon™ tubing). For military applications, the requirements for the tubing are not entirely similar to those for the pouch material. First, the tubing must be stiff enough to prevent collapse, but flexible enough to prevent kinking and allow ease of movement. Unfortunately, flexibility is usually related to permeability. Secondly, the tubing must be of a type approved for contact with potable water. It would seem the ideal tubing would consist of a layer of highly resistant fluoropolymer over a soft, flexible potable water formulated polymer. TFE fluoropolymers are inherently stiff and prone to kinking. Multilayer tubing is prone to difficulties with reliably sealing both tubes at the ends. A single layer tubing with the ability to both carry potable water and resist permeation and damage by both CBW agents and decontaminants was required. By choosing a flexible, chemical resistant tubing of a sufficient thickness to keep the permeation rate low, all requirements could be met.

Table 1 shows a listing of the several tubing materials. These were tested against dimethyl sulfoxide as an agent simulant. DMSO a is polar aprotic solvent and is specified as a chemical agent simulant because it quickly permeates skin, similar to CBW agents, but has relatively low toxicity. It thus provides a safe, worst case testing medium. Testing of tubing materials was performed by placing 20 ml of distilled water into 2 foot long sections of tubing, then immersing the center 12 inches of the tubing in a 50 vol % DMSO, 50 vol % water mix for 72 hours at room temperature and pressure. The water inside the tubes was then collected and tested for DMSO content using a Hewlett-Packard 5890 Series 2 gas chromatograph. Tubes were ¼"ID by 7/16"OD unless otherwise noted. Table 1 also shows the advantages and disadvantages of each tubing material.

TABLE 1

Tubing material DMSO challenge test results and advantages and disadvantages of each material. Minimum level of detection was 10 ppm. Materials such as silicone rubbers and fluoropolymers were not tested because they were too permeable or too rigid.

| Material | 72 hour water contamination by DMSO, ppm | Advantages | Disadvantages |
|---|---|---|---|
| Tygon lined EPDM (ethylene propylene diene monomer) | <10 | flexible highly resistant to permeation | extremely difficult to use with tube fittings |
| EPDM | <10 | single layer works well with fittings very flexible | imparts foul taste to water |
| Food grade Tygon, ⅜" OD | 23 (average 0.005 μg/cm$^2$/min) | NSF approved imparts no taste to water flexible single layer works well with fittings | somewhat permeable |
| Food grade Tygon, ½" OD | <10 | same as above, but longer protection will not kink | difficult to use with standard fittings (too thick) permeability |
| polyethylene lined ethyl vinyl acetate | <10 | tough and strong cut resistant low permeability FDA compliant seals well over barb fittings without hose clamps | inflexible can't use hose clamp valve to shut off flow possible infiltration between layers |
| fluorinated ethylene propylene lined Tygon | <10 | flexible low permeability | kinks easily cannot be used with barbed tube fittings or hose clamp valve |

EPDM tubing has the best properties from a mechanical and CBW viewpoint, but the taste of water passing through this tubing is revolting. Personnel would most likely begin suffering the effects of dehydration before they would want to drink water that contacted this tubing or any other rubber materials. It is suspected that residual unreacted sulfur contained in the rubber contaminates water in contact with it. Although not toxic, it takes very little contact time to make the water undrinkable. The Tygon food and beverage tubing, by contrast, was found to add no detectable taste to water. Further testing of a thicker wall ¼"ID by 7⁄16"OD food grade Tygon tubing for 96 hours in 50% percent DMSO revealed no contamination of the water inside. It is believed that the claimed exceptionally low porosity of this material keeps permeation rates low without excessive stiffness. From the above data, it was decided that this thickness of food-grade Tygon tubing sufficiently resists permeation and damage by solvents and alkaline solutions, yet provides good flexibility and adds no taste to contacting water. It should be appreciated, however, that the selection of superior materials for the tube may vary depending on end use.

A hydration system was constructed and subjected to a number of tests. As used herein, hydration system may also be referred to as a "water pouch," though the system is not limited to use of water as a fluid to be held in the reservoir of the bladder.

The first mechanical test of the water pouch was a drop test. A pouch was dropped from a height of eight feet onto a smooth concrete surface. This test was repeated for each of the 6 orthogonal directions relative to the water pouch. No damage occurred.

The next test was a pressurization test for leakage. A pouch was submerged under 6 inches of water, then pressurized internally to 4.0 psi with air. No leakage occurred. Next, this pouch was placed in a hydraulic load frame where. A load was applied in displacement control at a rate of 0.5 inches/minute. When held at 1000 lbs. load for 30 seconds, no damage occurred. When the load was increased to 1200 lbs., slow, noncatastrophic separation of the heat sealed area of the outer barrier material occurred in one location. The chemically bonded tape did not separate, however, so no holes actually appeared in the outer layer and no leakage occurred at this location. Approximately 5 ml of water leaked from the spout during this testing. Upon subsequent air pressure testing of the same pouch as described above, a bubble appeared every 5 to 10 seconds at one location on the spout when pressurized to 3.5 psi due to slippage of the pouch material relative to the spout. Subsequent redesign included a reinforcing ring of double thickness polyurethane in the spout region to address this weakness, even though these tests far exceed previous durability expectations.

To address the possibility of breakthrough of the inner layer without visible damage to the outer layer, several puncture tests were conducted using both FTMS 101 M2065 (round tip probe) and ASTM D 4833 (cylinder tip probe) test equipment. To test the pouch material as a system, both layers were placed in the test apparatus in the same configuration as in the pouch. In these tests, puncture of the outer material always occurred first. In fact, the physical limits of the test apparatus were reached before puncture of the urethane material.

The final mechanical test was designed to address the possibility of decompression at high altitude during ejection or mechanical failure. The maximum change in pressure that is expected to occur in flight is from filling and sealing at sea level (14.7 psia) to a final cabin altitude after decompression of 40,000 ft (2.7 psia). To simulate this effect, a pouch was placed in a vacuum chamber and the pressure was reduced from atmospheric to 2.7 psia. Although rapid decompression (<15 seconds) was not difficult to reproduce and did not effect the pouch, explosive decompression (<0.1 seconds) is more difficult and has not yet been simulated. Due to the incompressibility of water and a vapor pressure of only about 0.5 psi at room temperature, the water pouch had to be filled partially with air for this test to be of any consequence. Because the pouch is flexible and there will only be a small quantity of air inside, it is expected that explosive decompression will also have very little effect on the pouch. Decompression effects will be negligible if air is removed from the pouch before sealing. Thermal tests consisted of soaking and cycling between high and low temperatures. First, a filled pouch was placed in a freezer at 4° F. until frozen solid (approximately 20 hours).

After thawing, the same pouch was placed in an oven at 149° F. for 4 hours to simulate the hottest induced conditions expected, such as within an enclosed vehicle under bright sunlight on a hot day. Next the pouch was placed in a Tenney Environmental Test Chamber and exposed to 100 cycles between −13° F. and 203° F. at a rate of 2 cycles per hour for 100 hours. No damage occurred in any of these tests.

Although these water pouches have not yet been tested against actual chemical agents and decontaminants, testing of the complete pouches against a DMSO solution does provide a comparable measure of the ability of chemicals with high solvency to penetrate the materials and seals. Pouches were tested by immersing them in a 50% DMSO solution at room temperature for 24 hours. Samples were taken by withdrawing 15 ml aliquots through the drinking tube at exposure periods of 10 minutes, 2 hours, and 24 hours. Of three pouches tested, no DMSO contamination of the water contained inside was detected through 24 hours of exposure. Blind contaminated samples were used to verify the efficacy of the DMSO detection process.

It should be understood that this invention is not limited to a water pouch as described in detail above. This water pouch may be made in a variety of shapes and sizes, depending on a given end use. The pouch may be fitted with alternative fittings such as the cap and tubing dispenser, or no tubing. The cap/drinking component may be arranged to provide a traditional canteen type design. The pouch may be itself contained in a rigid vessel depending on end use.

The inner bladder may be readily fabricated using standard thermal welding of the polymeric material. Similarly, the inner layer of the outer protective coating is advantageously formed from a thermoplastic material which affords the ability to thermally weld the material together in any desired shape. The outer seams so formed may optionally be reinforced using a chemical adhesive to bond a rubber strip to the outer surface of the pouch.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as illustrative embodiments. Equivalent elements or materials may be substituted for those illustrated and described herein, and certain features of the invention may be utilized independently of the use of other features, all as would be apparent to one skilled in the art after having the benefit of this description of the invention.

What is claimed is:

1. A hydration system for providing fluid to a user, comprising:

a bladder configured to hold a fluid, wherein bladder comprises an outer layer of fluorinated rubber composite and an inner layer made of thermoplastic polyurethane, and wherein the fluorinated rubber composite includes at least one non-fluorinated rubber reinforcement layer for the fluorinated rubber;

a spout connected to the bladder and in communication with the inside of the bladder, wherein the spout comprises an output port and a fill port for filling the bladder with fluid;

a cap adapted to engage and close the fill port;

a tube having a first end connected to the output port of the spout and having a second end connected to a fluid delivery fitting.

2. The system of claim 1, wherein the bladder is flexible.

3. The system of claim 1, wherein the cap is adapted to screw into the fill port.

4. The system of claim 1, wherein the spout has a width and a height, wherein the width is greater than height.

5. The system of claim 4, wherein the tube is made of flexible plastic.

6. The system of claim 1, wherein the fluorinated rubber composite comprises a polyamide reinforcing layer and a thermoplastic polymer layer.

7. A process for manufacturing a hydration system, comprising:

connecting a spout to a laminate used to form a bladder by securing the spout in a hole in the laminate;

forming a bladder from the laminate, wherein the laminate comprises an outer fluorinated rubber composite layer that includes at least one non-fluorinated rubber reinforcement layer and an inner layer of a thermoplastic polymer;

connecting a first end of a tube to an output port of the spout; and connecting a fluid delivery fitting to a second end of the tube.

8. The process of claim 7, further comprising engaging a cap to an fill port of the spout.

9. The process of claim 7, wherein the bladder is flexible.

10. The process of claim 7, wherein the bladder comprises an inner layer of thermoplastic polymer is a thermoplastic polyurethane.

11. The process of claim 7, wherein the cap is adapted to screw into the output port.

12. The process of claim 7, wherein the spout has a width and a height, wherein the width is greater than height.

13. The process of claim 7, wherein the tube is made of flexible plastic.

14. The system of claim 7, wherein the fluorinated rubber composite comprises a polyamide reinforcing layer and a thermoplastic polymer layer.

15. A method of storing a fluid, comprising:

at least partially filling the hydration system through a fill port with a fluid, and closing the system by engaging the cap to the fill port, wherein the hydration system comprises:

a bladder configured to hold a fluid, wherein bladder comprises an outer layer of fluorinated rubber composite and an inner layer comprising a thermoplastic polyurethane, and wherein the fluorinated rubber composite includes at least one non-fluorinated rubber reinforcement layer for the fluorinated rubber;

a spout connected to the bladder and in communication with the inside of the bladder, wherein the spout comprises an output port and a fill port for filling the bladder with fluid;

a cap adapted to engage and close the fill port;

a tube having a first end connected to the output port of the spout and having a second end connected to a fluid delivery fitting.

16. The method of claim 15, wherein the bladder is flexible.

17. The method of claim 15, wherein the cap is adapted to screw into the fill port.

18. The method of claim 15, wherein the spout has a width and a height, wherein the width is greater than height.

19. The method of claim 15, wherein tube is made of flexible plastic.

20. The system of claim 15, wherein the fluorinated rubber composite comprises a polyamide reinforcing layer and a thermoplastic polymer layer.

21. A bladder to store fluid, comprising:

an inner bladder layer of a thermoplastic polymer and an outer bladder encompassing the inner bladder comprised of thermoplastic polyurethane, wherein the outer bladder layer comprises fluorinated rubber and at least one non-fluorinated rubber reinforcement layer for the fluorinated rubber.

22. The bladder of claim 21, wherein the outer bladder is comprised of a multiplayer laminate of the fluorinated rubber layer, a polyamide reinforcement layer, and a thermoplastic polymer layer.

23. The bladder of claim 21, wherein the bladder includes a hole to fill the bladder with liquid.

24. A hydration system for providing fluid to a user, comprising:

a bladder configured to hold a fluid, wherein the bladder comprises an outer layer of a fluorinated rubber composite and an inner layer of a thermoplastic polyurethane, and wherein the fluorinated rubber composite includes at least one non-fluorinated rubber reinforcement layer for the fluorinated rubber;

a spout connected to the bladder and in communication with the inside of the bladder, wherein the spout comprises an output port and a fill port for filling the bladder with fluid;

a cap adapted to engage and close the fill port;

a tube having a first end connected to the output port of the spout and having a second end connected to a fluid delivery fitting.

* * * * *